United States Patent [19]

Kazanjy

[11] Patent Number: 4,506,588

[45] Date of Patent: Mar. 26, 1985

[54] AMMUNITION HANDLING SYSTEM AND METHOD

[75] Inventor: Robert P. Kazanjy, Santa Ana, Calif.

[73] Assignee: Western Design Corp., Irvine, Calif.

[21] Appl. No.: 449,154

[22] Filed: Dec. 13, 1982

[51] Int. Cl.[3] ..... F41F 9/02

[52] U.S. Cl. ..... 89/34; 89/33.25; 89/33.5

[58] Field of Search ..... 89/33 R, 33 D, 33 B, 89/33 BA, 33 BB, 33 BC, 33 C, 33 CA, 33 E, 34, 35 R; 86/48, 47, 1 R

[56] References Cited

U.S. PATENT DOCUMENTS

| | | | |
|---|---|---|---|
| 564,043 | 7/1896 | Benet et al. | 89/35 R |
| 2,494,728 | 1/1950 | Stacey et al. | 89/33 BC |
| 2,713,288 | 7/1955 | Elms | 89/33 E |
| 2,789,474 | 4/1957 | Darsie | 89/33 CA |
| 3,229,584 | 1/1966 | Zehnder | 89/35 R |
| 3,333,506 | 8/1967 | Henshaw et al. | 89/33 CA |
| 3,696,704 | 10/1972 | Backus et al. | 89/33 BB X |
| 4,137,820 | 2/1979 | Clemens | 89/34 X |
| 4,281,583 | 8/1981 | Pollock et al. | 89/34 X |
| 4,397,216 | 8/1983 | Tassie | 89/33 CA |

FOREIGN PATENT DOCUMENTS 2443806 3/1975 Fed. Rep. of Germany ... 89/33 CA

OTHER PUBLICATIONS

"The Machine Gun–History, Evolution and Development of Manually Operated, Full Automatic, and Power Driven Aircraft Machine Guns", by George M. Chinn, reprinted by Edwards Brothers, 1951, pp. 190, 195, 202, 220, 221 and 354.

*Primary Examiner*—David H. Brown

*Attorney, Agent, or Firm*—Fowler, Lambert & Hackler

[57] ABSTRACT

An ammunition handling system includes a plurality of generally flat ammunition holding strips, each having clips thereon for holding a plurality of ammunition rounds and coupling apparatus disposed on each end thereof for releasably coupling the ammunition holding strips to one another for feeding the ammunition holding strips and the ammunition disposed thereon into an ammunition stripper and loader assembly. The ammunition stripper and loader assembly includes a chute for supporting at least one ammunition holding strip and apparatus for separating the ammunition rounds from the holding strips and feeding the separated ammunition rounds into an ammunition transfer unit of an automatic weapon.

13 Claims, 5 Drawing Figures

12
14
106
70
70
16
102
100
68
82
88
104
92
90
60
86
94
96
58
18
80
84
114
10
112
110
124
126
116
120
22
118
32
28
30
20

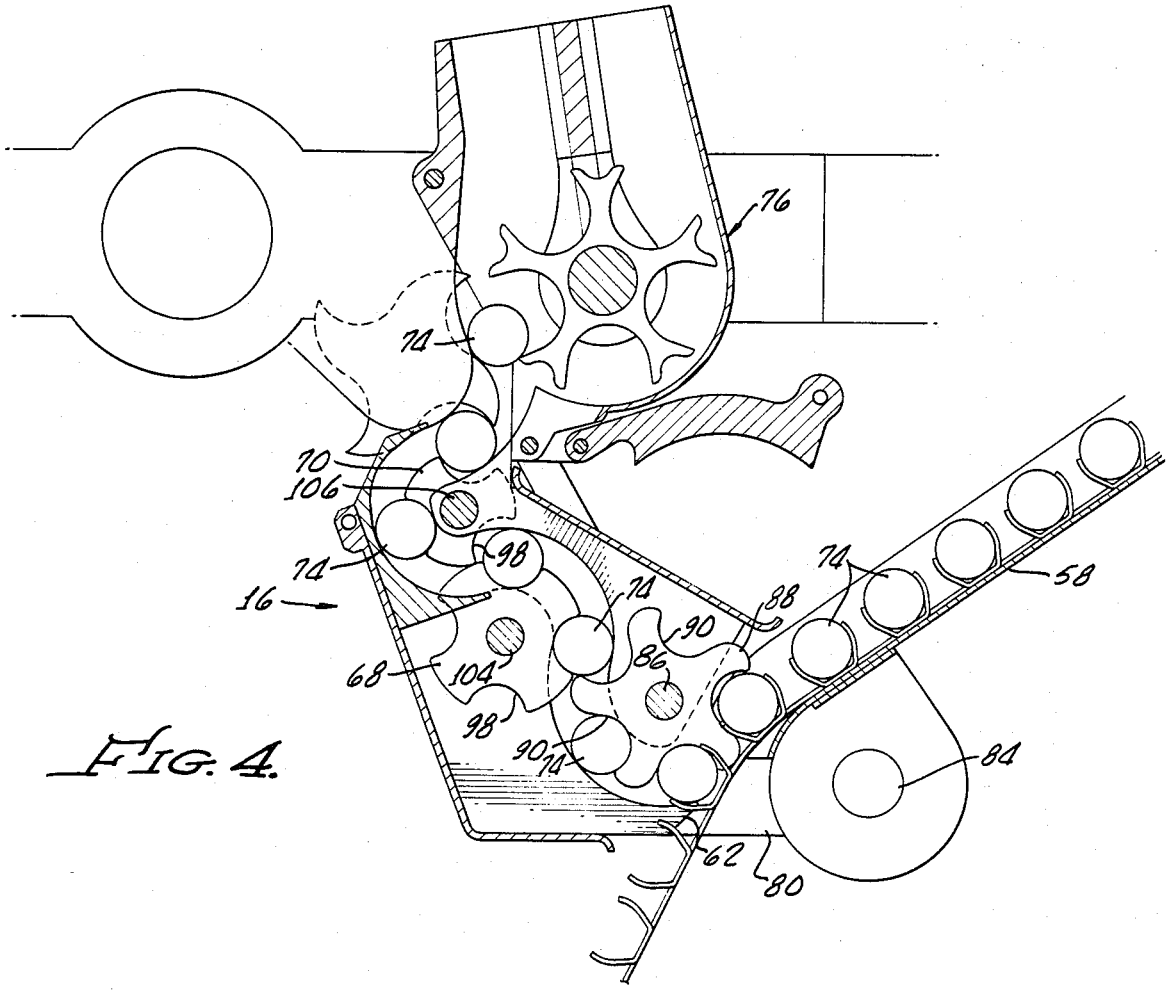
FIG. 4.
FIG. 5.
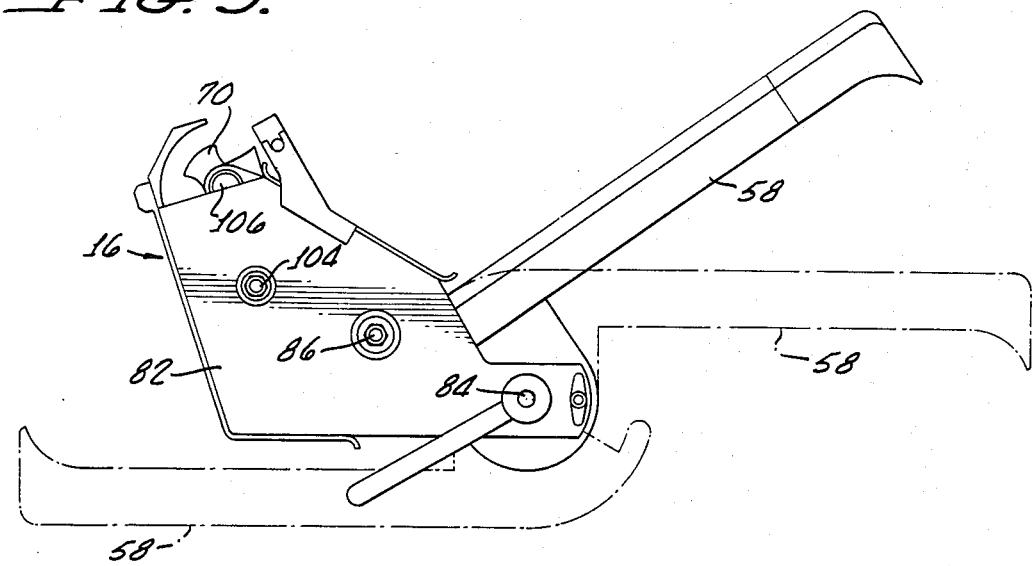

AMMUNITION HANDLING SYSTEM AND METHOD

The present invention is related to ammunition handling and storage systems, and more particularly to a bulk ammunition handling and storage system and method for reloading magazines of mobile gun installations, such as helicopter-mounted automatic weapons.

Typically, airborne weapon systems include non-removable ammunition magazines that must be reloaded with ammunition rounds to replace fired ammunition. Current practice includes manual reloading from bulk ammunition supplied in cartons or cases. This bulk, or loose, ammunition must be individually handled, thus causing a lengthy reloading time and poor ammunition round control.

An alternative system for reloading in current practice utilizes linked ammunition. In this system individual handling of the ammunition is eliminated; however, the system cost, because of the linked ammunition, is high, and because the linked ammunition occupies considerably more space than bulk ammunition, a greater volume is required to store equal amounts of ammunition. In addition, the links, or metal ammunition carriers, add considerably to the weight of the stored ammunition. These are important considerations when the ammunition must be carried to a reloading site, such as a returning helicopter on an airbase or in the field.

Recently developed linear linkless systems may be used which significantly reduce the volume and weight requirements for linked ammunition systems; however, these linkless systems are generally very costly because they include magazines having chain ladder assemblies for supporting the ammunition therein.

The present invention is directed to a bulk ammunition handling and storage system capable of positive ammunition control during reloading of mobile ammunition magazines without individual handling of ammunition rounds. In addition, the system enables dense pack storage of ammunition, not possible with linked ammunition storage systems. Further, the system of the present invention is lightweight and stowable in a portable storage container adapted to be manually carried to a loading site.

SUMMARY OF THE INVENTION

An ammunition handling system in accordance with the present invention includes a plurality of ammunition holding strips, each having clip means thereon for holding a plurality of ammunition rounds, and coupling means disposed on each end thereof for releasably coupling the ammunition holding strips to one another for feeding the ammunition holding strips and ammunition rounds disposed thereon into an ammunition stripper and loader assembly.

The utilization of separate ammunition holding strips facilitates handling of a plurality of ammunition rounds while enabling the ammunition to be stored in packs or crates at densities approaching that of bulk ammunition itself. By coupling of the ammunition holding strips as they are fed into the ammunition stripper and loader assembly, continuous controlled ammunition feeding is accomplished.

Also in accordance with the present invention, the ammunition handling system includes an ammunition stripper and loader assembly having load chute means for supporting at least one ammunition holding strip, means for separating the ammunition rounds from the ammunition holding strips, and means for feeding the separated ammunition rounds into an ammunition transfer unit of an automatic weapon.

The ammunition stripper and loader is operative to guide and control the ammunition round movement from the time the individual ammunition rounds are stripped from the holding strips until they reach the transfer unit of the automatic weapon, after which they are guided by the automatic weapon system into the magazine.

More particularly, the ammunition holding strips each include a generally flat portion with a plurality of pairs of clips thereon for holding the ammunition rounds in a generally parallel relationship along each ammunition holding strip. The generally flat configuration enables the holding strips, and ammunition rounds, to be readily stacked on one another within an ammunition container in a dense packed relationship.

The coupling means includes a notch formed in one end of each ammunition holding strip and hook means in another end of each ammunition holding strip with the hook means being configured for releasably engaging a notch of another ammunition holding strip.

In addition, the ammunition stripper and loader assembly includes drive rotor means configured for engaging the ammunition rounds, stripper means for engaging the ammunition holding strips, and means for feeding the separated ammunition rounds into the automatic weapon transfer unit. The drive rotor means and the stripper means are disposed in an operative relationship for separating the ammunition rounds from the spaced-apart clips, and the drive rotor means includes a wheel-like rotor having recesses therein for engaging the ammunition rounds.

The means for feeding the separated rounds into an ammunition feed well includes at least one wheel-like transfer rotor having recesses therein for holding and transferring ammunition rounds, the drive rotor and transfer rotor being in an operative relationship with one another for passing ammunition rounds therebetween.

A method for storing, handling and feeding ammunition rounds into an automatic weapon magazine in accordance with the present invention includes the steps of supporting a plurality of ammunition rounds along a generally flat ammunition holding strip, stacking a plurality of ammunition holding strips having a plurality of ammunition rounds thereon within an ammunition container for storage thereof, removing the ammunition holding strips from the ammunition container after storage, coupling the ammunition strips to one another, separating the ammunition rounds from the coupled ammunition strips, and feeding the separated ammunition rounds into an automatic weapon magazine.

BRIEF DESCRIPTION OF THE DRAWINGS

The foregoing and other features and advantages of the present invention will be apparent in the following description taken in conjunction with the accompanying drawings in which:

FIG. 4 is a cross-sectional view of the ammunition stripper loader in an operative relationship with an automatic transfer unit of an automatic weapon; and FIG. 5 is a side view of the ammunition stripper loader showing an ammunition loading chuting in an upward loading position, a level unloading, or downloading, position and a folded storage position.

DETAILED DESCRIPTION OF THE INVENTION

Figure 1:
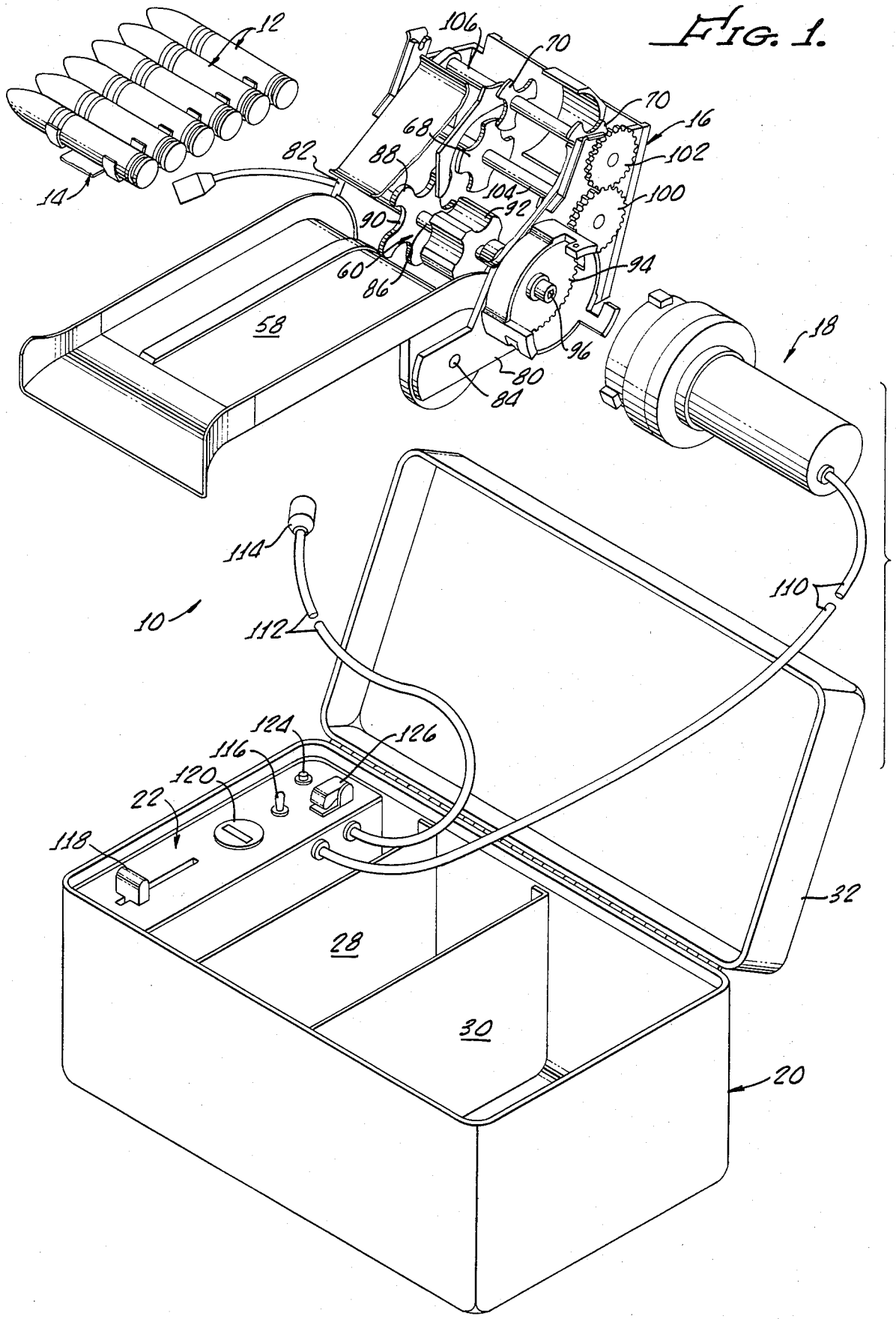
FIG. 1 is a perspective view of the ammunition handling system in accordance with the present invention generally showing one of a plurality of ammunition holding strips, an ammunition stripper and loader assembly, a removable motor assembly and a portable storage container for the ammunition stripper and loader assembly and the motor assembly.

Turning to FIG. 1, there is shown an ammunition handling system 10 in accordance with the present invention for the storage of ammunition rounds 12 and feeding of the ammunition rounds into an automatic weapon magazine (not shown in FIG. 1) generally including a plurality of ammunition holding strips 14 (only one being shown in FIG. 1), an ammunition stripper and loader assembly 16, a removable motor assembly 18 and a portable storage container 20 which provides means for housing an electrical control system 22 as well as having compartments 28, 30 therein sized for receiving the ammunition stripper and loader assembly 16 and motor assembly 18. A lid 32 is provided to enclose the stripper and loader assembly and motor assembly and may have a locking device and handle (neither shown) for manually transporting the portable storage container to a loading site.

Figure 2:
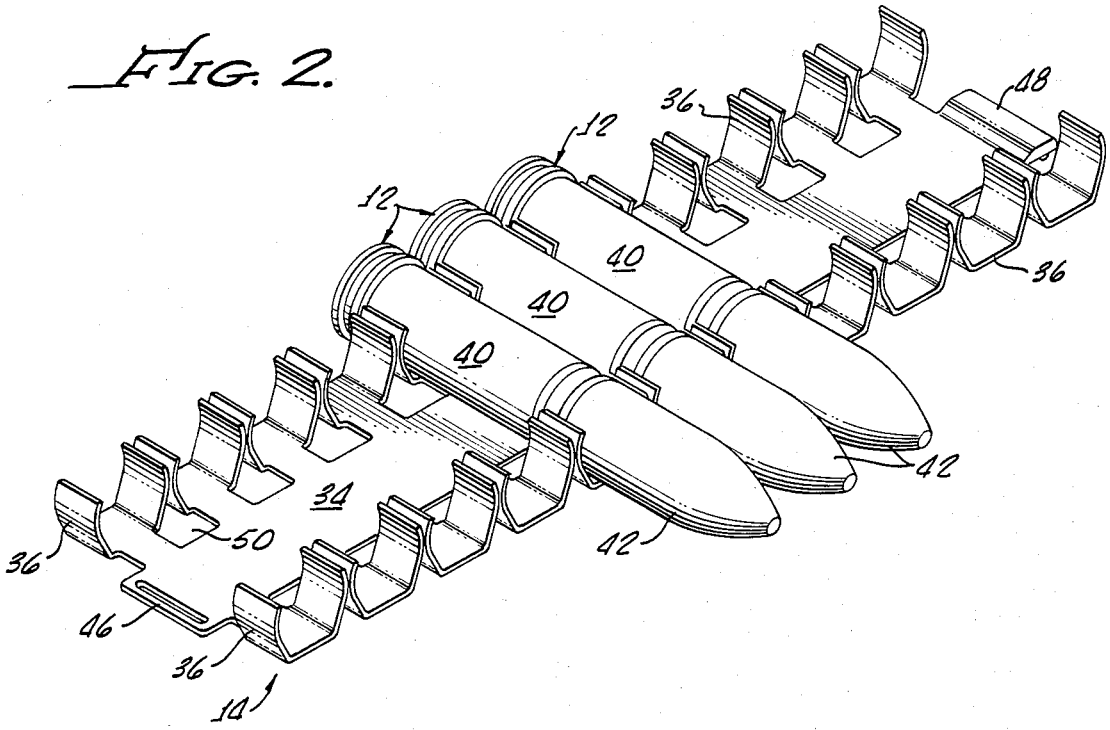
FIG. 2 is a perspective view of an ammunition holding strip showing clips for holding ammunition rounds with a few ammunition rounds removably secured to the holding strip.

More clearly shown in FIG. 2, each of the ammunition holding strips 14 includes a generally flat portion 34 having a plurality of pairs of spaced-apart clips 36 thereon for releasably holding ammunition rounds 12. Although the clips 36 and the flat portion of the strip 14 may be formed of metal and attached together by any suitable means, it may be preferable to form, or mold, the strip, including the flat portion and the clips, from a single piece of plastic material.

It is preferable, as will be discussed hereinafter in greater detail, in connection with stripping of the ammunition rounds 12 from the strip 14, that the flat portion 34 be flexible and thus be able to bend slightly without splitting or breaking.

While the ammunition handling system 10 may be used with ammunition calibers ranging from 20 mm to 35 mm, and the ammunition holding strips 14 may have a capacity dependent in part on the caliber of the ammunition rounds used, for 30 mm ammunition the strips may have eleven pairs of clips 36 for holding ammunition.

As shown in FIG. 2, the clips 36 may be spaced apart a preselected distance to enable each pair of the spaced-apart clips 36 to engage an ammunition round 12 along a casing 40 of the ammunition round to securely hold the ammunition rounds 12.

In order to continuously feed the ammunition holding strips 14, along with the ammunition rounds 12 carried thereby, into the ammunition stripper and loader assembly 16, means including a notch 46 and a hook 48 are provided to releasably couple the holding strips to one another as they are fed into the stripper and loader assembly.

As hereinbefore discussed, weight and volume, or packing density, of ammunition rounds is an important consideration. The holding strips 14 should be as thin as possible, while at the same time able to support the ammunition rounds 12 as the holding strips and ammunition rounds are handled during feeding into the stripper and loader assembly 16. It may be desirable to form cut out portions 50 along the flat portion 34 of the holding strip or within the holding strip (not shown) in order to reduce the weight and stiffness of the holding strip.

Figure 3:
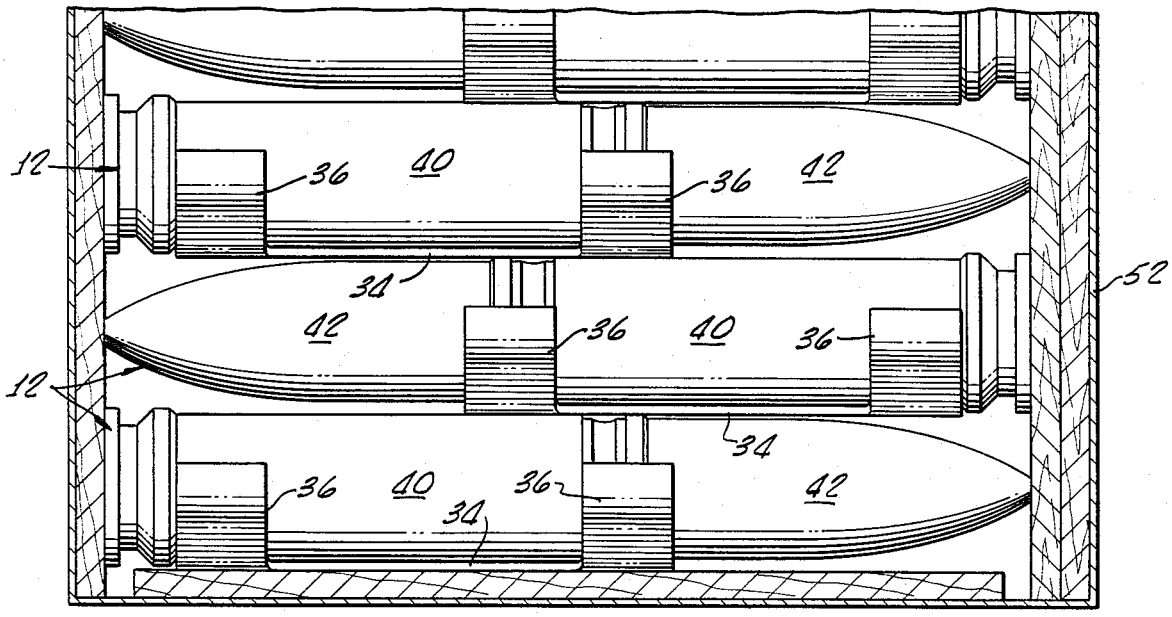
FIG. 3 is a cut-away, cross-sectional view of a plurality of stacked ammunition holding strips with ammunition rounds within an ammunition container showing the packing density enabled by the relatively thin holding strips.

Utilizing nylon as a molding material, the holding strip flat portion 34 may have a thickness of only about 2 mm which facilitates stacking of the holding strips and ammunition in a case, or container, 52; see FIG. 3.

Considering a conventional ammunition container (not shown) having a capacity of 121 rounds of bulk 30 mm ammunition plus packing, and weighing about 123 pounds, the same container may hold 110 rounds using the holding strips 14 of the present invention and weigh about 109 pounds. This relates to a weight efficiency (weight of ammunition/weight of package) of about 74% for bulk ammunition storage, and about 76% for ammunition storage utilizing the teachings of the present invention. The greater efficiency is enabled by the replacement of packing material in conventional bulk ammunition storage with the holding strips. In terms of packing density (number of ammunition rounds/volume of the container) the conventional bulk ammunition storage packing density for 30 mm ammunition is about 100 rounds/cu. ft., while the packing density in accordance with the present invention is about 91 rounds/cu. ft.

By comparison, current linked ammunition storage has a weight efficiency of about 58% and a packing density of about 60 rounds/cu. ft. due to the volume and weight of the links and complex system of separators which are stored with the ammunition.

Returning to FIG. 1, and as also shown in FIG. 4, the ammunition stripper and loader assembly 16 generally includes a load chute 58, a drive rotor system 60 for engaging the ammunition rounds 12, a stripper 62 for engaging the holding strips 14 and means including wheel-like transfer rotors 68, 70 for feeding the separated ammunition rounds into an ammunition feed well, or transfer unit 76, see FIG. 4, the transfer unit 76 not being part of the present invention.

The load chute 58 is sized to support at least one holding strip 14, and preferably more than one holding strip, to facilitate coupling of the holding strips by means of the notch 46 and hook 48 disposed on each strip. By supporting adjacent holding strips in a planar relationship elaborate coupling means need not be provided, as may be the case if the coupled strips are unsupported or undergo severe bending before reaching the drive rotor 60 and stripper 62.

Attached to side plates 80, 82 of the stripper and loader assembly 16 by means of pins 84, the chute 58 may be pivoted from an upward loading position to an intermediate position and a folded position, the latter two positions being shown in dashed lines in FIG. 5. The upward loading position guides the holding strips 14 into proper position within the stripper and loader assembly for engagement of the ammunition 12 with the drive rotor 60 and strip 14 with the stripper 62, respectively. The intermediate position enables ammunition rounds to exit the stripper and loader assembly when it is operated in reverse in order to download, or remove, ammunition rounds from the automatic weapon and magazine as may be necessary. Finally, the folded position of the chute 58 enables storage of the chute in the portable storage container 20.

Rotatably supported between the side plates 80, 82 by a shaft 86, the drive rotor system 60 includes a pair of ammunition engaging rotors 88, having recesses 90 therein for engaging ammunition rounds (only one being shown in the figure for clarity) separated by a stabilizing rotor 92. The shaft 86 extends through the side plate 80 and has a drive gear 94 mounted thereon and a socket 96 thereon which provides means for removably engaging the motor assembly 18.

Similarly, mounted between the side plates 80, 82 are the wheel-like transfer rotors 68, 70 which have recesses 98 therein for holding and transferring ammunition rounds and are spaced apart from each other and the drive rotor 88 so that an operative relationship exists therebetween for passing ammunition rounds from the drive rotor 88 to the transfer rotors 68, 70 and thereafter to the transfer unit 76.

Each of the transfer rotors 68, 70 are driven at speeds corresponding to smooth transfer of ammunition rounds by gears 100, 102 coupled to the transfer rotors 68, 70 by shafts 104, 106, respectively, and engaging in a serial manner the drive gear 96.

In operation, holding strips 14 along with ammunition rounds are coupled and placed in the chute 58. The recesses 90 in the drive wheel engage the ammunition rounds and by rotation of the drive rotor move the holding strips 14 and ammunition rounds 12 into the drive rotor, the recesses 90 and the spacing between the ammunition rounds being sized to enable a rack-and-gear like coupling therebetween. As the holding strip is pulled by the drive rotor it engages the stripper 62, the latter preventing the holding strip from being pulled in the direction of rotation of the drive rotor and thereby, in conjunction with the drive rotor, separates the ammunition rounds from the holding strip.

Continued rotation of the drive rotor passes the separated ammunition rounds to the recesses 98 in the transfer rotors 68, 70, the recess 98 and transfer rotor diameters being predetermined to enable the drive wheel and transfer wheels to act in concert to pass ammunition rounds therebetween.

The holding strip is ejected from the stripper and loader assembly after separation of ammunition therefrom and is available for reuse.

To facilitate efficient coupling between the drive rotor 88 and the ammunition rounds 12 disposed on the holding strips 14, it is preferable that the holding strips bend away from the drive rotor 88; hence a flexible holding strip is desirable.

Turning again to FIG. 1, the electrical control system 22, interconnected with the motor assembly 18 via a cable 110 and a control system of the automatic weapon (not shown) via a cable 112 and connector 114, provides means for controlling the speed and amount of ammunition rounds loading into the automatic weapon.

Conventional electric and electronic components may be employed in the electrical control system which includes an on-off switch 116, a speed control 118, an ammunition round counter 120, a direction switch, and an emergency stop switch 126, the direction switch enabling the stripper and loader assembly 16 to run in a reverse direction for downloading ammunition from the automatic weapon.

In operation, the ammunition handling system is utilized in the method of the present invention for storing, handling and feeding ammunition into an automatic weapon magazine.

Ammunition rounds are disposed in the holding strip clips, 14, manually or by machine for support thereon along the generally flat portion 34 thereon. A plurality of the ammunition holding strips 14 having a plurality of ammunition rounds thereon are stacked within a container 52 for storage thereof.

As hereinbefore pointed out, the packing density and the weight efficiency of the present method of storage is comparable with bulk ammunition storage and decidedly better than the present method of storing linked ammunition.

Following storage, the ammunition containers 52 are transported to a loading site along with the stripper and loader assembly 16, motor assembly 18 and control system 22. After the stripper and loader assembly is engaged with the transfer unit 76 of an automatic weapon and the motor assembly and control system are connected to the stripper and loader assembly, and the automatic weapon control system, respectively, the ammunition holding strips and ammunition are removed from the ammunition container 52 and coupled to one another as they are fed via the loading chute 58 into the stripper and loader assembly 16 for separation of the ammunition rounds from the coupled ammunition strips 14. Subsequently, the stripper and loader assembly transfers, or feeds, the separated ammunition rounds into the automatic weapon via the stripper and loader assembly 16 and the transfer unit 76.

As hereinbefore noted, this method of ammunition handling and storage eliminates individual handling of ammunition rounds as necessary in bulk ammunition storage systems, and hence significantly reduces loading time.

Although there has been described hereinabove a particular ammunition handling system and method in accordance with the present invention for the purpose of illustrating the manner in which the invention may be used to advantage, it should be appreciated that the invention is not limited thereto. Accordingly, any and all modifications, variations or equivalent arrangements which may occur to those skilled in the art, should be considered to be within the scope of the invention as defined in the appended claims.

I claim:

1. An ammunition handling system for storage of ammunition rounds and feeding of the ammunition rounds into an automatic weapon magazine comprising:

a plurality of ammunition holding strips, each said ammunition holding strip having clip means thereon for holding a plurality of ammunition rounds, and coupling means disposed on each end thereof for releasably coupling said ammunition holding strips to one another for feeding said ammunition holding strips and ammunition rounds into an ammunition stripper and loader assembly;

a separate manually transportable and portable storage container; and, an ammunition stripper and loader assembly sized for storage in said manually transportable and portable storage container comprising:

(a) load chute means for supporting at least one said ammunition holding stirp, (b) means for separating said ammunition rounds from said ammunition holding strips into separated ammunition rounds, and (c) means for feeding the separated ammunition rounds into an ammunition transfer unit of an automatic weapon.

2. The ammunition handling system of claim 1 wherein each said ammunition holding strip includes a generally flat portion and said clip means includes a plurality of spaced-apart clips for holding ammunition rounds in a generally parallel relationship along each ammunition holding strip.

3. The ammunition handling system of claim 2 wherein each said ammunition holding strip, including the spaced-apart clips, is formed from a single piece of material.

4. The ammunition handling system of claim 2 wherein each said ammunition holding strip is formed from a flexible material to enable bending of the generally flat portion.

5. The ammunition handling system of claim 4 wherein each said ammunition round is held by a pair of the spaced-apart clips.

6. The ammunition handling system of claim 5 wherein the spaced-apart clips are disposed on opposite sides of each said ammunition holding strip and the distance between the opposite sides is preselected to enable each pair of said spaced-apart clips to engage one said ammunition round along a casing portion of the ammunition round.

7. The ammunition handling system of claim 6 wherein the coupling means includes a notch formed in one end of each said ammunition holding strip and hook means in another end of each said ammunition holding strip for releasably engaging one of the notches of another said ammunition holding strip.

8. The ammunition handling system of claim 2 wherein the means for separating the ammunition rounds from the ammunition holding strips includes drive rotor means for engaging the ammunition rounds and stripper means for engaging the ammunition holding strips.

9. The ammunition handling system of claim 8 wherein the drive rotor means includes a wheel-like rotor having recesses therein for engaging said ammunition rounds and the means for feeding the separated ammunition rounds into said ammunition transfer unit includes at least one wheel-like transfer rotor having recesses therein for holding and transferring said ammunition rounds.

10. An ammunition handling system for storage of ammunition rounds and feeding of the ammunition rounds into an automatic weapon magazine comprising:

a plurality of ammunition holding strips including a generally flat portion having a plurality of pairs of clips thereon for holding ammunition rounds in a generally parallel relationship along each said ammunition holding strip and coupling means comprising a notch formed in one end of each said ammunition holding strip and hook means in another end of each said ammunition holding strip, said hook means being configured for releasably engaging one of said notches of another said ammunition holding strip;

a separate manually transportable and portable storage container; and, an ammunition stripper and loader assembly sized for storage in said manually transportable and portable storage container comprising:

(a) load chute means for supporting at least one said ammunition holding strip, (b) drive rotor means configured for engaging the ammunition rounds, (c) stripper means for engaging the ammunition holding strips and separating the ammunition rounds from the clips into separated ammunition rounds, and (d) means for feeding the separated ammunition rounds into the ammunition transfer unit of an automatic weapon.

11. An ammunition handling system for storage of ammunition rounds and feeding of the ammunition rounds into an automatic weapon magazine comprising:

a plurality of ammunition holding strips, each said ammunition holding strip having clip means thereon for holding a plurality of ammunition rounds, and coupling means disposed on each end thereof for releasably coupling said ammunition holding strips to one another for feeding said ammunition holding strips and ammunition rounds into an ammunition stripper and loader assembly;

a separate manually transportable and portable storage container; and, an ammunition stripper and loader assembly sized for storage in said manually transportable and portable storage container comprising:

(a) means for separating said ammunition rounds from said ammunition holding strips into separated ammunition rounds;

(b) foldable load chute means configured for being moved into a position for guiding the holding strips and ammunition round into the means for separating said ammunition rounds from said holding strips, moved into an intermediate position for enabling ammunition rounds to exit the stripper and ammunition loader assembly when it is operated in reverse and moved into a folded position for enabling storage of the ammunition stripper and loader assembly in the manually transportable and portable storage container, and (c) means for feeding the separated ammunition rounds into an ammunition transfer unit of an automatic weapon.

12. An ammunition handling system for storage of ammunition rounds and feeding of the ammunition rounds into and automatic weapon magazine comprising:

a plurality of ammunition holding strips including a generally flat portion having a plurality of pairs of clips thereon for holding ammunition rounds in a generally parallel relationship along each said ammunition holding strip and coupling means comprising a notch formed in one end of each said ammunition holding strip and hook means in another end of each said ammunition holding strip, said hook means being configured for releasably engaging one of said notches of another said ammunition holding strip;

a separate manually transportable and portable storage container; and, a removable motor assembly, sized for storage in said manually transportable and portable storage container; and, an ammunition stripper and loader assembly sized for storage in said manually transportable and portable storage container comprising:

(a) load chute means for supporting at least one said ammunition holding strip, (b) drive rotor means configured for engaging the ammunition rounds, said drive rotor means including means for removably engaging said removable motor assembly, (c) stripper means for engaging the ammunition holding strips and separating the ammunition rounds from the clips into separated ammunition rounds, and (d) means for feeding the separated ammunition rounds into an ammunition transfer unit of an automatic weapon.

13. An ammunition handling system for storage of ammunition rounds and feeding of the ammunition rounds into an automatic weapon magazine comprising:

a plurality of ammunition holding strips including a generally flat portion having a plurality of pairs of clips thereon for holding ammunition rounds in a generally parallel relationship along each said ammunition holding strip and coupling means comprising a notch formed in one end of each said ammunition holding strip and hook means in another end of each said ammunition holding strip, said hook means being configured for releasably engaging one of said notches of another said ammunition holding strip;

a separate manually transportable and portable storage container; and, a removable motor assembly, sized for storage in said manually transportable and portable storage container;

electrical control means disposed in said manually transportable and portable storage container and interconnected with the removable motor assembly, said electrical control means being adapted for connection with a control system of an automatic weapon for controlling the speed and amount of said ammunition rounds loaded into the automatic weapon magazine; and an ammunition stripper and loader assembly sized for storage in said manually transportable and portable storage container comprising:

(a) load chute means for supporting at least one said ammunition holding strip, (b) drive rotor means configured for engaging the ammunition rounds, said drive rotor means including means for removably engaging said removable motor assembly, (c) stripper means for engaging the ammunition holding strips and separating the ammunition rounds from the clips into separated ammunition rounds, and (d) means for feeding the separated ammunition rounds into the ammunition transfer unit of an automatic weapon.

* * * * *